US009761206B2

(12) United States Patent
Ban

(10) Patent No.: US 9,761,206 B2
(45) Date of Patent: Sep. 12, 2017

(54) WIND INSTRUMENT TRUMPET AND ITS MANUFACTURING AND MOLDING METHODS

(71) Applicant: ZHENGZHOU AUCS CO., LTD, Zhengzhou, Henan (CN)

(72) Inventor: Haibo Ban, Henan (CN)

(73) Assignee: ZHENGZHOU AUCS CO., LTD, Zhengzhou (CN)

( * ) Notice: Subject to any disclaimer, the term of this patent is extended or adjusted under 35 U.S.C. 154(b) by 0 days.

(21) Appl. No.: 15/205,052

(22) Filed: Jul. 8, 2016

(65) Prior Publication Data

US 2016/0322035 A1 Nov. 3, 2016

Related U.S. Application Data

(63) Continuation-in-part of application No. PCT/CN2014/077137, filed on May 9, 2014.

(30) Foreign Application Priority Data

Jan. 25, 2014 (CN) ..... 2014 1 0034694

(51) Int. Cl.
*G10D 7/10* (2006.01)
*G10D 7/00* (2006.01)
*G10D 9/00* (2006.01)

(52) U.S. Cl.
CPC ..... *G10D 7/10* (2013.01); *G10D 7/005* (2013.01); *G10D 9/005* (2013.01)

(58) Field of Classification Search
CPC ..... G10D 7/10; G10D 7/005; G10D 9/005
See application file for complete search history.

(56) References Cited

U.S. PATENT DOCUMENTS 2,320,202 A * 5/1943 Thompson ..... G10D 7/10 84/388
2,320,203 A * 5/1943 Thompson ..... G10D 7/10 84/388

(Continued)

FOREIGN PATENT DOCUMENTS

CN 201757987 U 3/2011
CN 102483911 A 5/2012

(Continued)

OTHER PUBLICATIONS

1st Office Action of counterpart Chinese Patent Application No. 201410034694.0 issued on Jun. 15, 2015.

(Continued)

*Primary Examiner* — Robert W Horn

(57) ABSTRACT

The present invention provides a wind instrument trumpet and its manufacturing and molding methods. The wind instrument trumpet of the present invention adopts polymeric material with integrated molding process, reducing trumpet spare part quantities and optimizing spare part structure. Moreover, the wind instrument trumpet of the present invention has a lighter overall structure and purer tone quality by applying integrated molding process to the piston outer pipe of tuning component. The present invention greatly decreases the quantity of spare parts, improves assembly accuracy and efficiency, reasonably controls the accuracy of a single spare part while improving the matching accuracy considerably, ensures the movement direction of keys more effectively through the coordination with the piston outer tubes so that the keys are smoother compared to the traditional ones.

8 Claims, 5 Drawing Sheets

(56) References Cited

U.S. PATENT DOCUMENTS 2,471,290 A * 5/1949 Sommaruga ..... G10D 7/08 84/385 R
2,551,177 A * 5/1951 Sommaruga ..... G10D 7/08 84/385 R
3,264,925 A * 8/1966 Linton, Sr. ..... G10D 7/06 84/380 R
3,308,707 A * 3/1967 Kelischek ..... G10D 7/063 84/330
3,375,746 A * 4/1968 Proll ..... G10D 9/043 446/208
3,393,263 A * 7/1968 Brilhart ..... B29C 39/00 264/131
3,447,415 A * 6/1969 Kime ..... G09B 15/06 267/177
3,805,665 A * 4/1974 Oouchi ..... G10D 7/023 84/380 C
3,835,748 A * 9/1974 Olson ..... G10D 9/04 84/388
4,860,629 A * 8/1989 Del Giudice ..... G10D 7/10 84/395
4,997,402 A * 3/1991 Blease ..... A01M 31/004 116/137 R
4,998,456 A * 3/1991 Kahonen ..... G10D 7/005 84/384
5,027,685 A * 7/1991 Lenz ..... G10D 9/043 84/330
6,696,629 B1 * 2/2004 Cooper, Jr. ..... G10D 7/08 84/385 R
6,852,917 B2 * 2/2005 McAleenan ..... G10D 7/005 84/380 R
7,097,533 B2 * 8/2006 Szekely ..... A63H 5/00 446/213
7,179,977 B1 * 2/2007 Kelly ..... G10D 9/026 84/387 R
7,560,631 B1 * 7/2009 John ..... G10D 9/026 84/398
7,608,768 B2 * 10/2009 Thanyakij ..... G10D 7/005 84/380 R
7,732,690 B2 * 6/2010 Miyaoka ..... G10D 7/005 84/380 R
8,324,491 B1 * 12/2012 Malluck ..... G10D 7/10 84/380 R
8,461,439 B2 * 6/2013 Rashleigh ..... G10D 7/10 84/387 R
9,520,111 B1 * 12/2016 Clissold ..... G10D 7/08
2003/0015082 A1 * 1/2003 Brennan ..... B29C 33/444 84/380 R
2005/0072291 A1 * 4/2005 Biba ..... G10D 7/10 84/453
2015/0317961 A1 * 11/2015 Harper ..... G10D 9/04 84/392
2016/0322035 A1 * 11/2016 Ban ..... G10D 7/10

FOREIGN PATENT DOCUMENTS

CN 203276810 U 11/2013
CN 203444747 U 2/2014

OTHER PUBLICATIONS

International Search Report of PCT Patent Application No. PCT/CN2014/077137 issued on Oct. 27, 2014.

* cited by examiner

WIND INSTRUMENT TRUMPET AND ITS MANUFACTURING AND MOLDING METHODS

CROSS REFERENCE TO RELATED APPLICATIONS

The present application is a Continuation-in-Part Application of PCT application No. PCT/CN2014/077137 filed on May 9, 2014, which claims the benefit of Chinese Patent Application No. 201410034694.0 filed on Jan. 25, 2014. All the above are hereby incorporated by reference.

TECHNICAL FIELD

The present invention relates to a wind instrument and its manufacturing and molding methods, specifically, a wind instrument trumpet and its manufacturing and molding methods.

BACKGROUND

Wind instrument is a kind of musical instrument commonly used in musical performance. It is generally made of brass, alloy or other metals. Its overall production process is complex and production cost is expensive, especially there also exists many problems with regard to its structural coordination. As for a trumpet used by a beginning (player or student) of a wind instrument or used in the teaching process, the intonation of a metal-made trumpet is prone to distortion, difficult to adjust and susceptible to permanent deformation when bumped, resulting in the trumpet scrapped. Therefore, the methods adopted in this application are to change the trumpet material and its molding process so as to reduce the overall production cost significantly while maintaining melodious and beautiful sound, and reducing the whole trumpet weight greatly.

SUMMARY OF THE INVENTION

The objective of this invention aims at the above-mentioned problems and deficiencies, providing effective manufacturing and molding methods to improve production efficiency and reduce production cost for wind instrument trumpet.

To achieve the above objective, the following technical proposal is adopted: A wind instrument trumpet comprises an air-blowing component, a tuning component and a sound component connected in sequence; wherein the air-blowing component comprises a mouthpiece, a mouthpiece long tube mounted on the outer side of the mouthpiece and a U-type tubular section connecting the long tube of the mouthpiece and the tuning component; the tuning component comprises three piston outer tubes with the same structure connected side by side; three piston inner cores with the same structure mounted in the corresponding piston outer tubes, as well as a first tuning pipe, a second tuning pipe and a central tuning pipe mounted on three piston outer tubers respectively in a connected way; the sides of three piston outer pipes protrude are respectively connected with the air-blowing component and sound component; the piston inner core comprises an inner core body, an internal piston sleeve fixed on the outer side of the inner core body and an outer piston sleeve fixed on the inner wall of the piston outer tube; the sound component comprises a flare tube which comprises a flare tube component D and a flare tube component E; one end of the flare tube is connected with the tuning component; the mouthpiece long tube, U-type tubular section, inner core body and piston outer tube are all made of polymeric material.

Further, the U-type tubular section comprises an U-type tubular section A and an U-type tubular section B which are made of polymeric material; the U-type tubular section A comprises two paralleled straight tubes at both ends and a semi-arc tube connecting the said two straight pipes with an integrated molding structure; the U-type tubular section B comprises another semi-arc tube matching and connecting to the semi-arc tube of U-type tubular section A;

Further, the flare tube component D is an integrated molding structure of a flare straight tube, a semi-arc tube in the middle part and a semicircle straight tube used for connecting the tuning component; the flare tube component E is an integrated molding structure of another semi-arc tube matching and connecting to the semi-arc tube of flare tube component D and another semicircle straight pipe matching and connecting to the semi-arc tube of flare tube component D.

Further, the first tuning pipe comprises interconnected U-type tuning pipe B and elbow B; the second tuning pipe comprises interconnected U-type tuning pipe C and elbow C; both U-type tuning pipe B and U-type tuning pipe C comprise integrated molding component of paralleled straight pipes at both ends and a semi-arc tube in the middle part, and also comprise another semi-arc tube component matching and connected to the integrated molding component; the central tuning pipe is an integrated structure;

Further, the upper part of the inner core body is a hollow cavity; there are key rod, piston spring and spring bracket within the hollow cavity from top to bottom in sequence; both sides of the spring bracket have a protruding catch; the inner core body and the piston outer tube respectively have a guiding groove and a limit stop matching to the bracket catch; the lower part of the inner core body comprises semi-cylindrical inner core sleeve rod F which is in integrated mold shaping with the upper part of inner core body and another semi-cylindrical inner core sleeve rod G matching with the inner core sleeve rod F; internal piston sleeve is fixed on the outer part of inner core sleeve rod F and inner core sleeve rod G; a key cover and a key cap are respectively arranged on the upper and the lower part of the piston outer tube.

Further, a metal tube is contained within the first half of the mouthpiece long tube; the metal tube is fixed on the first half of the inner wall of mouthpiece long tube through injection molding process; a depressed steps matching with the metal tube is arranged on the inner wall of the mouthpiece long tube; a taper matching with the mouthpiece is arranged on the front end of the metal tube; the mouthpiece is connected with the metal tube.

Further, the water-releasing keys are arranged on the U-type tubular section and elbow C.

Further, the second tuning pipe and the other two tuning pipes are mounted on the front and rear sides of three piston outer tubes.

Further, the polymeric material is any one of polycarbonate, ABS, polystyrene; the metal pipe and the piston outer pipe are all made of metal materials; the metal material is any one of stainless steel, brass, or cupronickel.

The manufacturing and molding methods of a wind instrument trumpet comprise the manufacturing process of air-blowing component, tuning component and sound component. The procedures are detailed as follows:

I: The air-blowing component includes mouthpiece, long tube of mouthpiece and U-type tubular section. The aforesaid mouthpiece is made of polymeric material through injection molding, or through turning solid polymeric material. The aforesaid mouthpiece long tube is made of polymeric material through integrated molding process. The preceding U-type tubular section and mouthpiece long tube are joined by plugging; U-type tubular section is mainly comprised of U-type tubular section a and U-type tubular section b. U-type tubular section a is an integrated molded component of two paralleled straight tubes at both ends and a semi-arc tube connecting two straight pipes; U-type tubular section b includes another semi-arc tube matching and connected to the semi-arc tube of U-type tubular section a through ultrasonic welding or adhesive bonding;

II: Tuning component comprises three piston outer tubes with the same structure connected side by side, three piston inner cores with the same structure mounted in the corresponding piston outer tubes, as well as the first tuning pipe, the second tuning pipe and the central tuning pipe mounted on three piston outer tubers respectively in a connected way. The forgoing piston inner core includes an inner core body which is made of polymeric material, internal piston sleeve mounted and fixed on the outer side of inner core body, as well as outer piston sleeve fixed on the inner wall of piston outer tube through injection molding process. Both of the said inner piston sleeve and outer piston sleeve are made by metal material drilling and honing process. The above-mentioned three piston outer tubes are integrated-key outer tubes with an integrated molding structure; the sides of three piston outer pipes protrude connecting tubes that are connected to the first tuning pipe, the second tuning pipe and the central tuning pipe; two piston outer tubes at both ends of three piston outer tubes protrude connecting tubes that are connected to air-blowing component and sound component respectively. The forgoing first tuning pipe includes interconnected U-type tuning pipe b and elbow b; the second tuning pipe includes interconnected U-type tuning pipe c and elbow c; both U-type tuning pipe b and U-type tuning pipe c include integrated molded component of paralleled straight pipes at both ends and semi-arc tube in the middle part, and also include another semi-arc tube component matching and connected to that integrated molding component through ultrasonic welding or adhesive bonding process; the forgoing central tuning pipe is a tuning pipe with an integrated molding structure.

III: Sound component includes flare tube; the above-mentioned flare tube comprises flare tube component d and flare tube component e which are made of polymeric material; flare tube component d comprises a flare straight tube, a semi-arc tube in the middle part and a semicircle straight tube made by integrated molding process and used for connecting the tuning component; the flare tube component e includes a semi-arc tube and semicircle straight pipe of the other half integrated molding structure matching and connected to the semi-arc tube and semicircle straight pipe of flare tube component d through ultrasonic welding and adhesive bonding.

There is a metal tube contained within the first half of the aforesaid mouthpiece long tube. The metal tube is fixed on the first half of the inner wall of mouthpiece long tube through injection molding process. On the inner wall of mouthpiece long tube, there are depressed steps matching with the metal tube. At the front end of the metal tube, there is a taper matching with mouthpiece. The aforesaid mouthpiece is connected with the metal tube.

Both of the above-mentioned U-type tubular section and elbow c have water-releasing keys. The forgoing second tuning pipe and the other two tuning pipes are mounted on the front and rear sides of three piston outer tubes.

The forgoing polymeric material is any one of polycarbonate, ABS, polystyrene; the forgoing metal material is any one of stainless steel, brass, or cupronickel.

The benefits obtained from the above-mentioned technical proposal are:

1. The present invention reduces the production cost, decreases the trumpet weight and facilitates performer's long-time playing by changing the traditional manufacturing material of trumpet;

2. Through the material change, the present invention further improves and simplifies the quantities of spare parts with reference to the molding process, further consolidates integrated structure, significantly increases the accuracy of and between the spare parts and effectively improves negative factors due to material change;

3. The present invention, a section of metal tube is added between mouthpiece and mouthpiece long tube in order to further guarantee timbre and tone quality. In the meantime, an integrated design is carried out on the piston outer tube to effectively ensure the quality and efficiency of mass production as well as to realize the effective connection and matching with other components;

4. The present invention greatly decreases the quantity of spare parts, improves assembly accuracy and efficiency, reasonably controls the accuracy of a single spare part while improving the matching accuracy considerably and enhancing tone quality;

5. The inner core body of the present invention adopts a brand new structural design. In conjunction with the piston outer tubes, it ensures the movement direction of keys more effectively so that the keys are smoother than the traditional ones.

The numbers in the diagrams: 1. air-blowing component, 2. mouthpiece, 102. mouthpiece long tube, 103. U-type tubular section a, 104. U-type tubular section b, 105. metal tube, 2. tuning component, 201. the first tuning pipe, 202. the second tuning pipe, 203. the central tuning pipe, 204. inner core body, 205. internal piston sleeve, 206. outer piston sleeve, 207. connecting tube, 208. U-type tuning pipe b, 209. elbow, 210. U-type tuning pipe c, 211. elbow c, 212. key rod, 213. piston spring, 214. spring bracket, 215. guiding groove, 216. piston sleeve rod F, 217. piston sleeve rod G, 218. upper key cover, 219. key cap, 220. piston outer tube, 3. sound component, 301. flare tube component d, 302. flare tube component e, 4. water-releasing key.

DETAILED DESCRIPTION OF THE PREFERRED EMBODIMENT

The following detailed descriptions with attached diagrams are made for the specific implementation means of the present invention.

Embodiment 1

Figure 1:
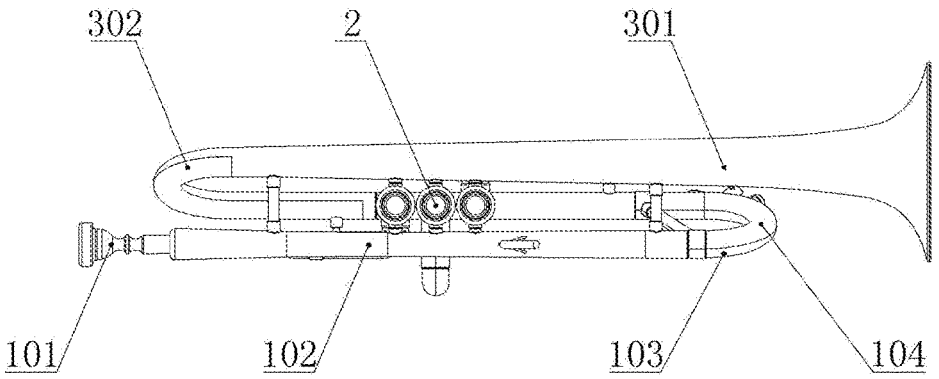
FIG. 1 is a structural schematic diagram of the present invention.
Figure 2:
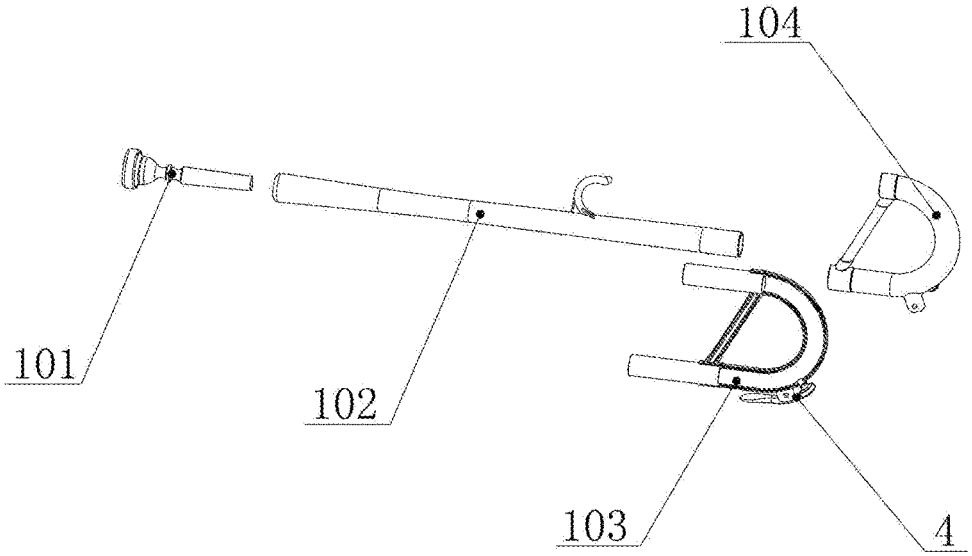
FIG. 2 is an exploded structural schematic diagram of air-blowing component.
Figure 3:
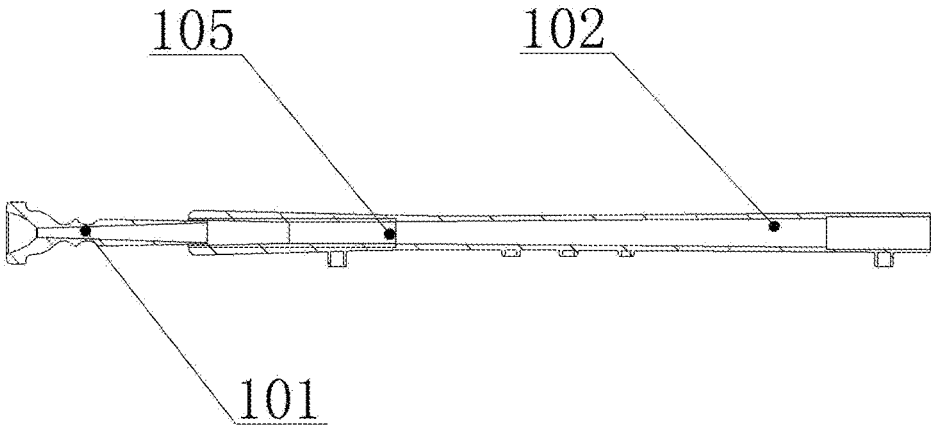
FIG. 3 is a matching structural schematic diagram of mouthpiece and mouthpiece long tube.
Figure 4:
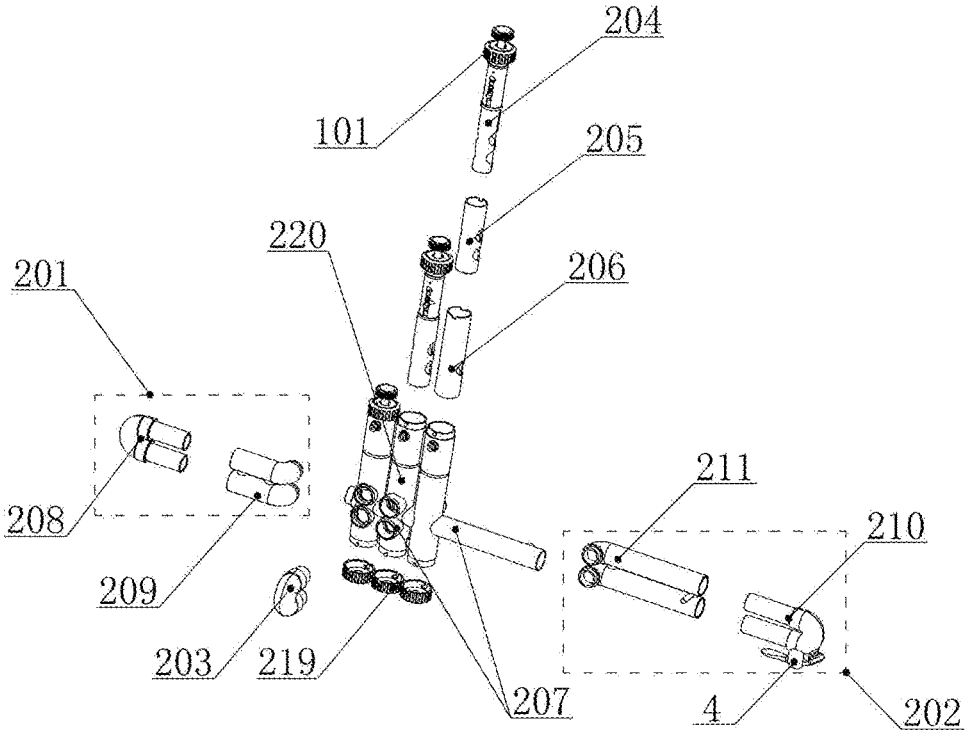
FIG. 4 is an exploded structural schematic diagram of tuning component.
Figure 5:
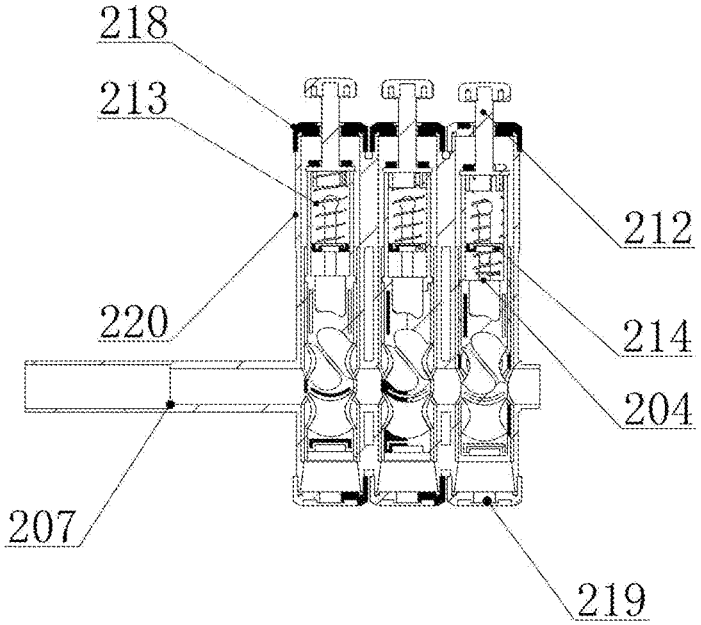
FIG. 5 is a perspective structural schematic diagram of tuning component.
Figure 6:
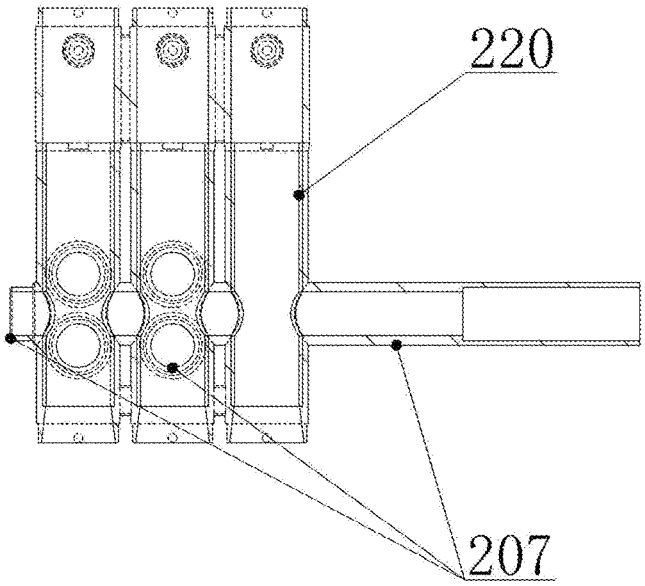
FIG. 6 is a structural schematic diagram of piston outer tube.
Figure 7:
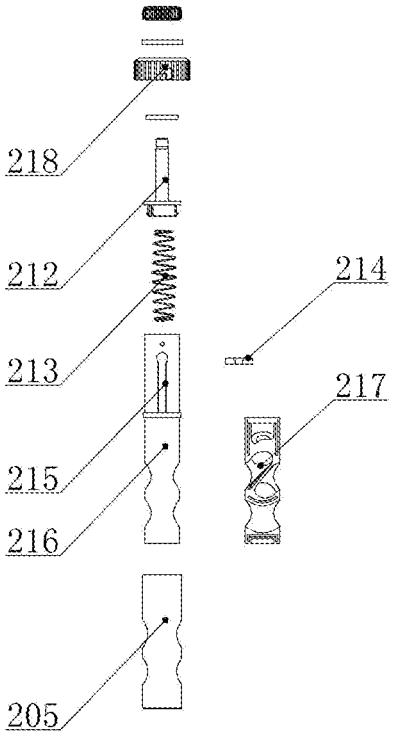
FIG. 7 is a structural schematic diagram of piston inner core.
Figure 8:
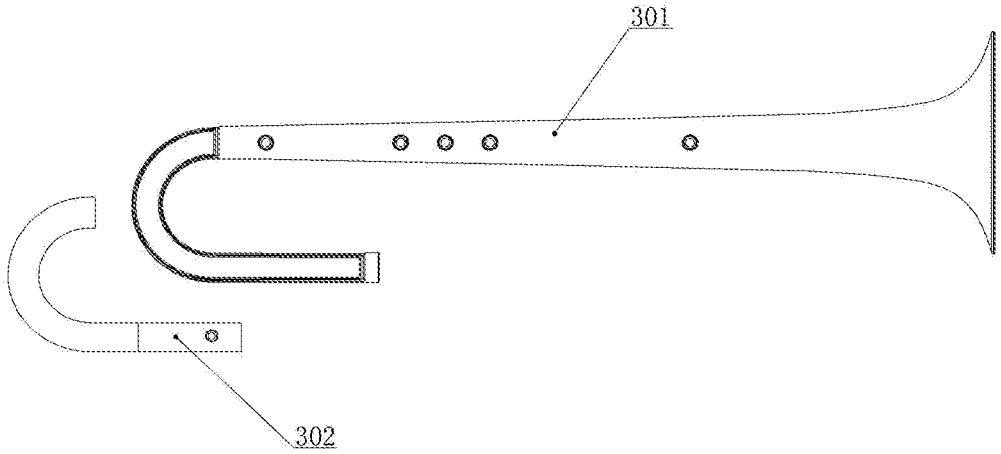
FIG. 8 is a structural schematic diagram of sound component.
Figure 9:
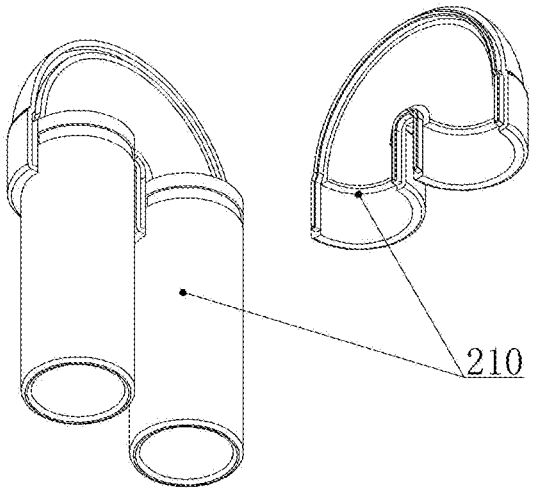
FIG. 9 is a structural schematic diagram of U-type tuning pipe c.
Figure 10:
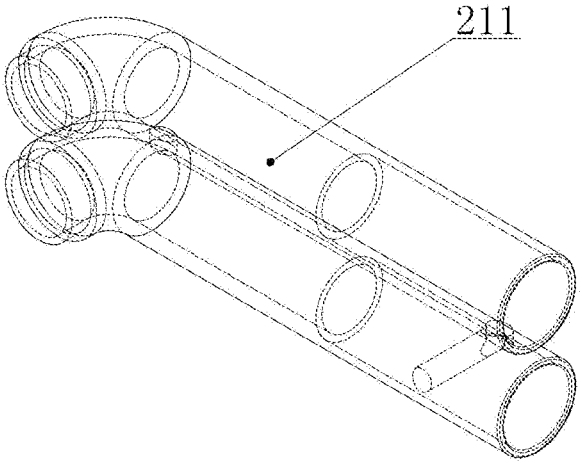
FIG. 10 is a structural schematic diagram of elbow c.

See FIG. 1-FIG. 10; a wind instrument trumpet includes air-blowing component 1, tuning component 2 and sound component 3 connected in sequence; the aforesaid air-blowing component 1 includes mouthpiece 101, a mouthpiece long tube 102 mounted on the outer side of the mouthpiece 101 and a U-type tubular section connecting the mouthpiece long tube 102 and the tuning component 2; both ends of the U-type tubular section are inserted into mouthpiece long tube 102 and tuning component 2 respectively; the aforesaid tuning component 2 includes three piston outer tubes 220 with the same structure connected side by side, three piston inner cores with the same structure mounted in the corresponding piston outer tubes 220, as well as the first tuning pipe 201, the second tuning pipe 202 and the central tuning pipe 203 mounted on three piston outer tubers 220 respectively; the aforesaid sound component 3 includes flare tube; the forgoing mouthpiece long tube 102 is made of polymeric material with an integrated molding structure; U-type tubular section is comprised of U-type tubular section a 103 and U-type tubular section b 104; U-type tubular section a 103 consists of two paralleled straight tubes at both ends and a semi-arc tube connecting two straight pipes with an integrated molding structure; U-type tubular section b 104 includes the other semi-arc tube matching and connected to the semi-arc tube of U-type tubular section a through ultrasonic welding or adhesive bonding. The three forgoing piston outer tubes 220 are made by integrated molding process; the piston inner core comprises an inner core body 204 made of polymeric material, an internal piston sleeve 205 made of metal material and fixed on the outer side of the inner core body 204, as well as an outer piston sleeve 206 made of metal material and fixed on the inner wall of the piston outer tube 220. The front and rear sides of 3 piston outer pipes protrude connecting tubes 207 that are connected to the first tuning pipe 201, the second tuning pipe 202 and the central tuning pipe 203; the preceding second tuning pipe 202 and the other two tuning pipes are set on the front and rear sides of three piston outer tubes 220; two piston outer tubes 220 at both ends of three piston outer tubes protrude connecting tubes 207 that are connected to air-blowing component 1 and sound component 3 respectively. The forgoing first tuning pipe 201 includes interconnected U-type tuning pipe b 208 and elbow b 209; the second tuning pipe 202 includes interconnected U-type tuning pipe c 210 and elbow c 211; both U-type tuning pipe b 208 and U-type tuning pipe c 210 include integrated molding component of paralleled straight pipes at both ends and semi-arc tube in the middle part, and also include another semi-arc tube component matching and connected to that integrated molding component through ultrasonic welding or adhesive bonding; the forgoing central tuning pipe 203 is a tuning pipe with an integrated structure. The above-mentioned flare tube comprises flare tube component d 301 and flare tube component e 302; flare tube component d 301 is an integrated molding structure of a flare straight tube, a semi-arc tube in the middle part and a semicircle straight tube used for connecting the tuning component with an integrated molding structure; the flare tube component e 302 includes a semi-arc tube and semicircle straight pipe of the other half integrated molding structure matching and connected to the semi-arc tube and semicircle straight pipe of flare tube component d 301 through ultrasonic welding or adhesive bonding; there are water-releasing keys 4 arranged on the preceding U-type tubular section and elbow c 211.

There are arc grooves arranged on the semi-arc tube and the end surface matching to the semi-arc tube as well as on the semicircle straight tube and the end surface matching to the semicircle straight tube; welding bar is placed in the arc groove to facilitate position assembly and welding.

There is also a bracing beam arranged at the U-type tubular section to ensure the parallelism and accuracy of the connection. Fixed rods are set between the air-blowing component, tuning component and sound component to connect the three of them together so that the trumpet has a more consolidated overall structure.

The upper part of the forgoing inner core body 204 is a hollow cavity; there are key rod 212, piston spring 213 and spring bracket 214 within the hollow cavity from top to bottom in sequence; both sides of the spring bracket 214 have a protruding bracket catch; the inner core body 204 and the piston outer shell 220 respectively have a guiding groove 215 and a limit stop matching to the bracket catch; the lower part of the inner core body 204 comprises semi-cylindrical inner core sleeve rod 16 which is in integrated mold shaping with the upper part of inner core body and another semi-cylindrical inner core sleeve rod G 217 matching with the inner core sleeve rod 16; internal piston sleeve 205 is fixed on the outer part of inner core sleeve rod 16 and inner core sleeve rod G 217; there are also upper key cover 218 and key cap 219 at the upper and lower part of piston outer tube 220. Through the guiding and positioning of spring bracket, pressing-key rod 212 allows inner core body 204 to slide freely in the piston outer tube 220.

The forgoing polymeric material is any one of polycarbonate, ABS, polystyrene; the forgoing metal material is any one of stainless steel, brass, or cupronickel.

Embodiment 2

See FIG. 1-FIG. 10; the structure in this embodiment is basically the same as the embodiment one, therefore, no repeat for the similarities; the differences lie in: there is a metal tube 105 contained within the first half of the aforesaid mouthpiece long tube 102; the metal tube 105 is fixed on the first half of the inner wall of mouthpiece long tube 102 through injection molding process; on the inner wall of mouthpiece long tube 102, there are depressed steps matching with the metal tube 105; the aforesaid mouthpiece 101 is connected with the metal tube 105.

Embodiment 3

See FIG. 1-FIG. 10. The manufacturing and molding methods of a wind instrument trumpet comprise the manufacturing process of air-blowing component, tuning component and sound component. The procedures are detailed as follows:

I: The air-blowing component 1 includes mouthpiece 101, mouthpiece long tube 102 and U-type tubular section. The aforesaid mouthpiece 101 is made of polymeric material through injection molding, or through turning solid polymeric material. The mouthpiece 101 is connected with mouthpiece long tube 102; the preceding mouthpiece long tube 102 is made of ABS or other polymeric materials through integrated molding process. The both ends of the above-mentioned U-type tubular section are connected with mouthpiece long tube 102 and tuning component 2 respectively; U-type tubular section is mainly comprised of U-type tubular section a 103 and U-type tubular section b 104; U-type tubular section a 103 includes two paralleled straight tubes at both ends and a semi-arc tube connecting two straight pipes with an integrated molding structure; the two forgoing paralleled straight tubes are respectively used for inserting in mouthpiece long tube 102 and tuning component 3; U-type tubular section b 104 includes another semi-arc tube matching and connected to the semi-arc tube of U-type tubular section a 103 through ultrasonic welding or adhesive bonding;

II: Tuning component comprises three piston outer tubes 220 with the same structure connected side by side, three piston inner cores with the same structure mounted in the corresponding piston outer tubes 220, as well as the first tuning pipe 201, the second tuning pipe 202 and the central tuning pipe 203 mounted on three piston outer tubers 220 respectively. The forgoing piston inner core includes an inner core body 204 which is made of polymeric material, internal piston sleeve 205 mounted and fixed on the outer side of inner core body 204, as well as outer piston sleeve 206 fixed on the inner wall of piston outer tube 220 through injection molding process. Both of the preceding inner piston sleeve 205 and outer piston sleeve 206 are made by metal material drilling and honing process. The three above-mentioned piston outer tubes 220 are integrated-key outer tubes with an integrated molding structure; the front and rear sides of three piston outer pipes 220 protrude connecting tubes 207 that are connected to the first tuning pipe 201, the second tuning pipe 202 and the central tuning pipe 203; two piston outer tubes at both ends of three piston outer tubes 220 protrude connecting tubes 207 that are connected to air-blowing component 1 and sound component 3 respectively. The forgoing first tuning pipe 201 includes interconnected U-type tuning pipe b 208 and elbow b 209; the second tuning pipe includes interconnected U-type tuning pipe c 210 and elbow c 211; both U-type tuning pipe b 208 and U-type tuning pipe c 210 include integrated molded component of paralleled straight pipes at both ends and semi-arc tube in the middle part, and also include another semi-arc tube component matching and connected to that integrated molded component through ultrasonic welding or adhesive bonding process; the forgoing central tuning pipe 203 is a tuning pipe with an integrated molding structure.

III: Sound component includes flare tube; the above-mentioned flare tube comprises flare tube component d 301 and flare tube component e 302; flare tube component d 301 is integrated molding structure of a flare straight tube, a semi-arc tube in the middle part and a semicircle straight tube used for connecting the tuning component; the flare tube component e 302 includes a semi-arc tube and semicircle straight pipe of the other half integrated molding structure matching and connected to the semi-arc tube and semicircle straight pipe of flare tube component d 301 through ultrasonic welding and adhesive bonding.

There are arc grooves arranged on the end surface of the semi-arc tube matching to the semi-arc tube as well as on the end surface of the semicircle straight tube matching to the semicircle straight tube; welding bar is placed in the arc groove to facilitate position assembly and welding.

There is also a bracing beam arranged at the U-type tubular section to ensure the parallelism and accuracy of the connection. Fixed rods are set between the air-blowing component, tuning component and sound component to connect the three of them together so that the trumpet has a more consolidated overall structure.

Both of the above-mentioned U-type tubular section and elbow c 211 have water-releasing keys 4. The forgoing second tuning pipe 202 and the other two tuning pipes are mounted on the front and rear sides of three piston outer tubes 220.

The forgoing polymeric material is any one of polycarbonate, ABS, polystyrene; the forgoing metal material is any one of stainless steel, brass, or cupronickel.

Embodiment 4

See FIG. 1-FIG. 10; there is a metal tube 105 mounted within the first half of the aforesaid mouthpiece long tube 102. The metal tube 105 is fixed on the first half of the inner wall of mouthpiece long tube 102 through injection molding process. On the inner wall of mouthpiece long tube 102, there are depressed steps matching with the metal tube 105. At the front end of the metal tube 105, there is a taper matching with mouthpiece 101; the aforesaid mouthpiece 101 is connected with the metal tube 105.

What is claimed is:

1. A wind instrument trumpet, comprising an air-blowing component, a tuning component and a sound component connected in sequence; wherein the air-blowing component comprises a mouthpiece, a mouthpiece long tube mounted on the outer side of the mouthpiece and a U-type tubular section connecting the mouthpiece long tube and the tuning component; the tuning component comprises three piston outer tubes with the same structure connected side by side; three piston inner cores with the same structure mounted in the corresponding piston outer tubes, as well as a first tuning pipe, a second tuning pipe and a central tuning pipe mounted on three piston outer tubers respectively in a connected way; the sides of three piston outer tubes protrude are respectively connected with the air-blowing component and sound component; the piston inner core comprises an inner core body, an internal piston sleeve fixed on the outer side of the inner core body and an outer piston sleeve fixed on the inner wall of the piston outer tube; the sound component comprises a flare tube which comprises a flare tube component d and a flare tube component e; one end of the flare tube is connected with the tuning component; the mouthpiece long tube, U-type tubular section, inner core body and piston outer tube are all made of polymeric material;

wherein the U-type tubular section comprises an U-type tubular section a and an U-type tubular section b which are made of polymeric material; the U-type tubular section a comprises two paralleled straight tubes at both ends and a semi-arc tube connecting the two straight pipes with an integrated molding structure; the U-type tubular section b comprises another semi-arc tube matching and connecting to the semi-arc tube of U-type tubular section a.

2. The wind instrument trumpet according to claim 1, wherein the flare tube component d is an integrated molding structure of a flare straight tube, a semi-arc tube in the middle part and a semicircle straight tube used for connecting the tuning component; the flare tube component e is an integrated molding structure of another semi-arc tube matching and connecting to the semi-arc tube of flare tube component d and another semicircle straight pipe matching and connecting to the semi-arc tube of flare tube component d.

3. The wind instrument trumpet according to claim 1, wherein the first tuning pipe comprises interconnected U-type tuning pipe b and elbow b; the second tuning pipe comprises interconnected U-type tuning pipe c and elbow c; both U-type tuning pipe b and U-type tuning pipe c comprise integrated molding component of paralleled straight pipes at both ends and a semi-arc tube in the middle part, and also comprise another semi-arc tube component matching and connected to the integrated molding component; the central tuning pipe is an integrated structure.

4. The wind instrument trumpet according to claim 1, wherein the upper part of the inner core body is a hollow cavity; there is a key rod, piston spring and a spring bracket within the hollow cavity from top to bottom in sequence; both sides of the spring bracket have a protruding catch; the inner core body and the piston outer tube respectively have a guiding groove and a limit stop matching to the bracket catch; the lower part of the inner core body comprises semi-cylindrical inner core sleeve rod F which is in integrated mold shaping with the upper part of inner core body and another semi-cylindrical inner core sleeve rod G matching with the inner core sleeve rod F; internal piston sleeve is fixed on the outer part of inner core sleeve rod F and inner core sleeve rod G; a key cover and a key cap are respectively arranged on the upper and the lower part of the piston outer tube.

5. The wind instrument trumpet according to claim 1, wherein a metal tube is contained within the first half of the mouthpiece long tube; the metal tube is fixed on the first half of the inner wall of mouthpiece long tube through injection molding process; a depressed steps matching with the metal tube is arranged on the inner wall of the mouthpiece long tube; a taper matching with the mouthpiece is arranged on the front end of the metal tube; the mouthpiece is connected with the metal tube.

6. The wind instrument trumpet according to claim 1, wherein water-releasing keys are arranged on the U-type tubular section and elbow c.

7. The wind instrument trumpet according to claim 1, wherein the second tuning pipe and the other two tuning pipes are mounted on the front and rear sides of three piston outer tubes.

8. The wind instrument trumpet according to claim 5, wherein the polymeric material is any one of polycarbonate, ABS, polystyrene; the metal tube and the piston outer pipe are all made of metal materials; the metal material is any one of stainless steel, brass, or cupronickel.

* * * * *